US007118084B2

(12) United States Patent
Park

(10) Patent No.: US 7,118,084 B2
(45) Date of Patent: Oct. 10, 2006

(54) ADJUSTABLE EASEL

(76) Inventor: Young Chul Park, 5170 Finehill Ave., Glendale, CA (US) 91214

( * ) Notice: Subject to any disclaimer, the term of this patent is extended or adjusted under 35 U.S.C. 154(b) by 164 days.

(21) Appl. No.: 10/872,217

(22) Filed: Jun. 18, 2004

(65) Prior Publication Data

US 2005/0279907 A1 Dec. 22, 2005

(51) Int. Cl.
*A47B 97/04* (2006.01)

(52) U.S. Cl. ..... 248/460; 248/464

(58) Field of Classification Search ..... 248/460, 248/462, 463, 464, 458, 451, 447, 448, 454, 248/457, 441.1; 40/606.15, 610; 312/241, 312/240

See application file for complete search history.

(56) References Cited

U.S. PATENT DOCUMENTS 2,634,542 A * 4/1953 Bode ..... 248/457
4,093,326 A * 6/1978 Ford ..... 312/231
4,372,630 A * 2/1983 Fuhri ..... 312/231
5,855,329 A * 1/1999 Pagano ..... 248/451
5,979,856 A * 11/1999 Hsu ..... 248/441.1
6,682,042 B1 * 1/2004 Anderson ..... 248/460
6,745,988 B1 * 6/2004 Gelfand ..... 248/460
6,772,987 B1 * 8/2004 Jones, II ..... 248/464
6,971,621 B1 * 12/2005 Gaines ..... 248/447

* cited by examiner

*Primary Examiner*—Ramon O Ramirez
(74) *Attorney, Agent, or Firm*—John K. Park; Park Law Firm

(57) ABSTRACT

An adjustable easel having a canvas holder and a base is provided. The canvas holder is attached to the base in a way that the canvas holder can swivel with respect to the base and the canvas holder can be tilted with respect to the base. A connecting device includes a canvas holder bracket that is fixed to the canvas holder, a first shaft on which the canvas holder bracket is rotatably attached so that the canvas holder can be tilted, a second shaft on which the first shaft is fixed, and a base bracket that is fixed to the base. The base bracket is rotatably attached to the second shaft so that the canvas holder can swivel. The canvas holder includes a gripping device that grips a canvas and is adjustable to accommodate different sizes of the canvas.

15 Claims, 6 Drawing Sheets

ADJUSTABLE EASEL

BACKGROUND OF THE INVENTION

The present invention relates to an adjustable easel. More particularly, this invention relates to an adjustable easel that provides maximum degree of positional flexibility and versatility related to functions of the easel.

While there are many easels that allow some degree of adjusting the position of a canvas that they hold, none of them provides a full degree of freedom that a user requires. Also, stability of a mechanism adjusting the position of a canvas while providing convenience of adjusting without a tool or excessive force was not satisfactory.

An adjustable easel, which can provide full degree of freedom, stable and convenient operation of canvas position adjustment, compact size and portability, and versatile storage space, has long been in need.

SUMMARY OF THE INVENTION

The present invention contrives to solve the disadvantages of the prior art.

An objective of the invention is to provide an adjustable easel that provides maximum degree of freedom that a user of the easel requires.

Another objective of the invention is to provide an adjustable easel having a stable mechanism to provide the degree of freedom.

Still another objective of the invention is to provide an adjustable easel that can hold varying sizes of canvases with a simple and quick operation.

To accomplish the above objectives, the present invention provides an adjustable easel having a canvas holder and a base. The canvas holder is attached to the base in a way that the canvas holder can swivel with respect to the base and the canvas holder can be tilted with respect to the base.

The base includes three or more legs that are pivotally attached to the base, and the length of each of the legs is adjustable.

The base also includes a storage compartment and one or more covers that cover the storage compartment in its closed position, and allow access into the storage compartment in its open position.

Each of the covers is pivotally attached to the storage compartment with one or more hinges. Each of the hinges includes a bracket that includes a first plate and a second plate that is orthogonally attached to the first plate.

The storage compartment of the base has a rectangular shape and includes a bottom wall, a front wall, a rear wall and two side walls. The three legs includee a first leg, a second leg and a third leg. The first leg and the second leg are pivotally attached to the side walls of the storage compartment. The third leg is pivotally attached to the bottom wall. The third leg is received in a recess that is provided in the bottom wall.

The adjustable easel further includes a connecting device that connects the canvas holder to the base. The connecting device includes a canvas holder bracket that is fixed to the canvas holder, a first shaft on which the canvas holder bracket is rotatably attached so that the canvas holder can be tilted, a second shaft on which the first shaft is fixed, and a base bracket that is fixed to the base. The base bracket is rotatably attached to the second shaft so that the canvas holder can swivel.

The connecting device further includes first elastic element assembled on the first shaft and presses the canvas holder bracket, and a second elastic element assembled on the second shaft and presses the base bracket.

Each of the first elastic element and the second elastic element includes a cone-shaped spring washer.

The canvas holder includes a gripping device that grips a canvas. The gripping device is adjustable to accommodate different sizes of the canvas.

The gripping device includes a first bar, a second bar, a first end piece and a second end piece. The first bar partially overlaps the second bar and the overlapping length is adjustable. The first end piece is attached to the first bar and contacts the canvas. The second end piece is attached to the second bar and contacts the canvas.

The first end piece includes a first knob and a first threaded portion extending from the first knob and engaged with a first threaded hole provided in the first bar. The second end piece includes a second knob and a second threaded portion extending from the second knob and engaged with a second threaded hole provided in the second bar.

The first threaded portion has a right-handed thread, and the second threaded portion has a left-handed thread.

The gripping device further includes an auxiliary knob that engages with the second knob, so that a thin object can be held between the auxiliary knob and the second knob.

The canvas holder further includes a supporting body that supports the first bar and the second bar in a way that the first bar and the second bar slide on each other.

The supporting body includes a recess that receives the first bar and the second bar, and a fastener that fastens the first bar and the second bar together.

The canvas holder further includes a holding bar that is attached to the supporting body and contacts the canvas.

The holding bar includes one or more elongated recesses. Each of the elongated recesses has different width.

The advantages of the present invention are: (1) an adjustable easel for holding a canvas that can swivel the canvas 360° and tilt the canvas 235° is provided; (2) the easel can hold various sizes of the canvas; (3) the canvas can be held with a quick and intuitive operation; (4) a picture can be conveniently held beside the canvas held by the easel; and (5) the easel is compact and portable with light weight legs.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
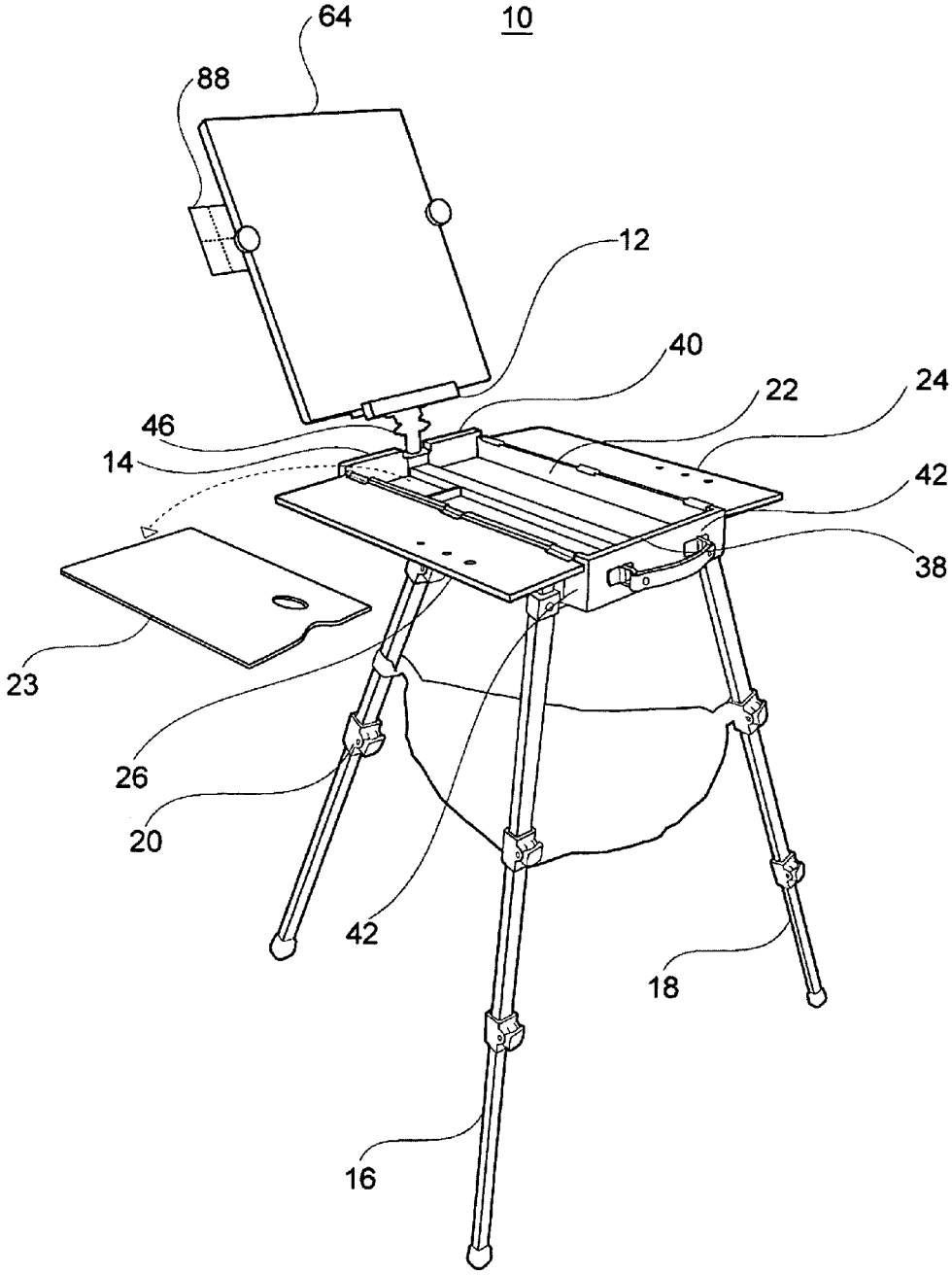
FIG. 1 is an illustrative perspective view of an adjustable easel of the present invention.
Figure 2:
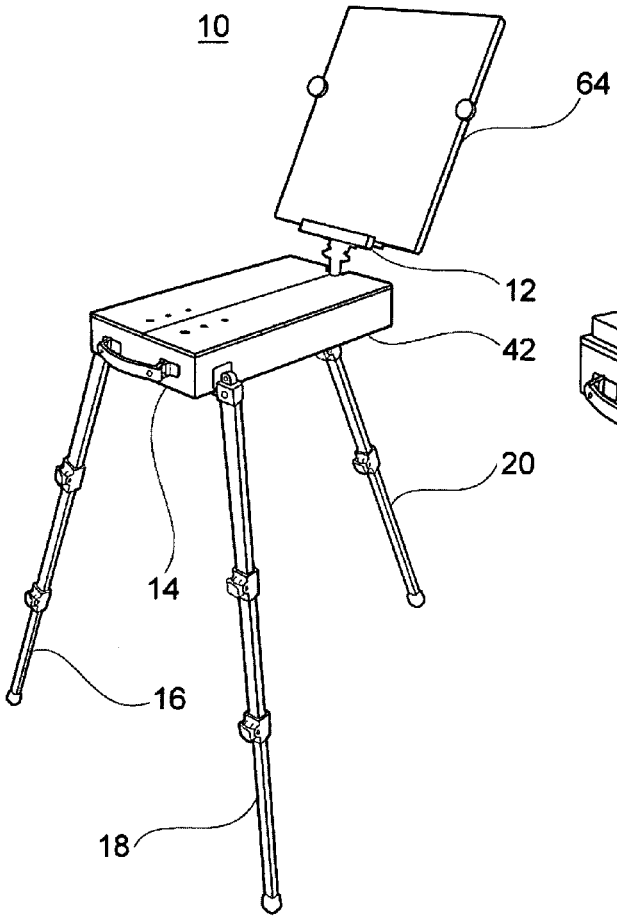
FIG. 2 is a view similar to FIG. 1 showing covers of a storage box are closed.
Figure 3:
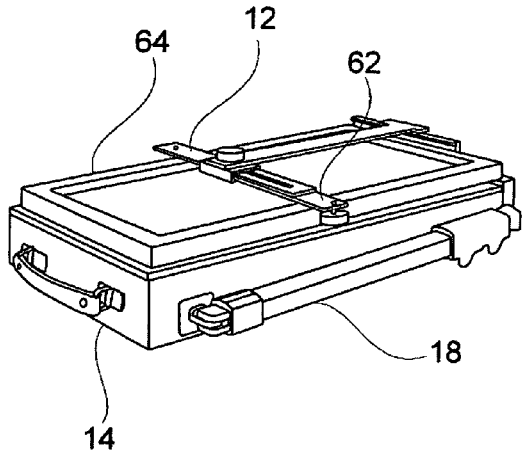
FIG. 3 is a partial perspective view showing a canvas holder is folded upon the storage box.

FIGS. 1–3 show an adjustable easel 10 having a canvas holder 12 and a base 14. The canvas holder 12 is attached to the base 14 in a way that the canvas holder 12 can swivel with respect to the base 14 and the canvas holder 12 can be tilted with respect to the base 14.

The base 14 includes a first leg 16, a second leg 18, and a third leg 20 that are pivotally attached to the base 14, and the length of each of the legs 16, 18, 20 is adjustable.

The base 14 also includes a storage compartment 22 and a first cover 24 and a second cover 26 that cover the storage compartment 22 in its closed position, and allow access into the storage compartment 22 in its open position. Other accessories, such as a palette 23 may be provided as part of the adjustable easel 10. The palette 23 is stored in the storage compartment 22.

Figure 5:
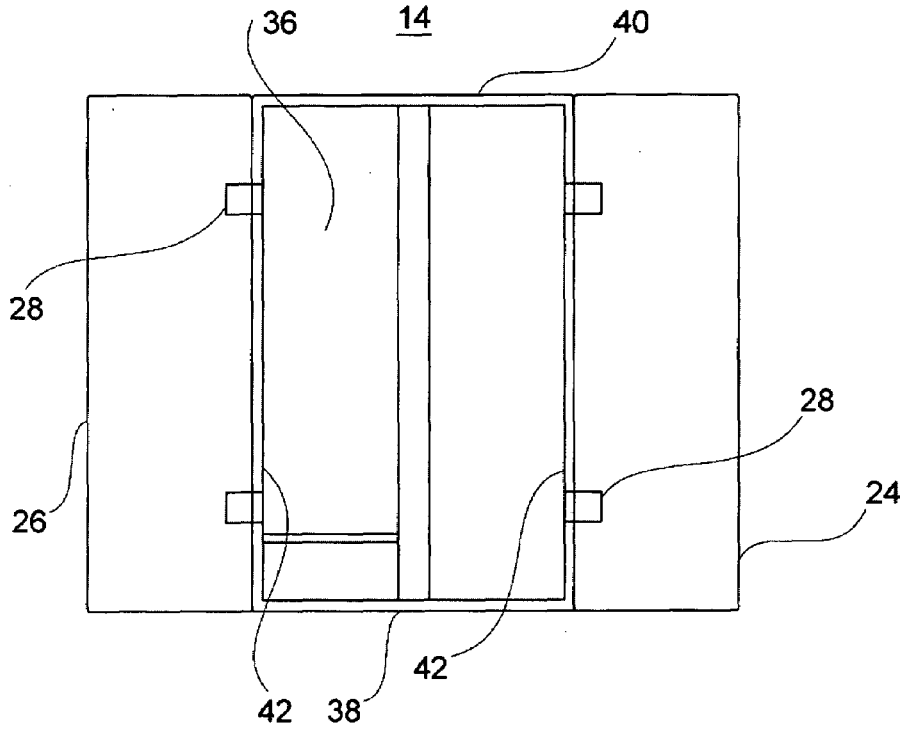
FIG. 5 is a plan view of a base with a storage compartment and two covers.
Figure 6:
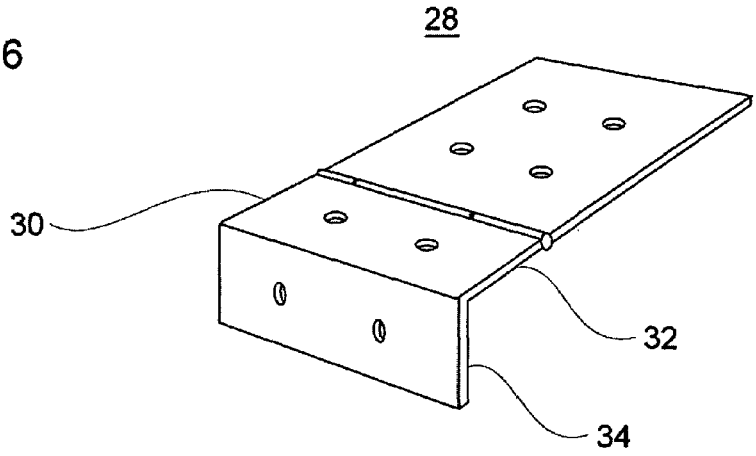
FIG. 6 is a perspective view of a hinge that connects the covers to the storage compartment.

As shown in FIG. 5, each of the covers 24, 26 is pivotally attached to the storage compartment 22 with one or more hinges 28. As shown in FIG. 6, each of the hinges 28 includes a bracket 30 that includes a first plate 32 and a second plate 34 that is orthogonally extended from the first plate 32. With the bracket 30, the hinge 28 can be fixed to the storage compartment 22 contacting two surfaces that are orthogonal thereby increasing strength and reducing space required for fixing.

Referring back to FIG. 5, the storage compartment 22 of the base 14 has a rectangular shape and includes a bottom wall 36, a front wall 38, a rear wall 40 and two side walls 42.

Figure 7:
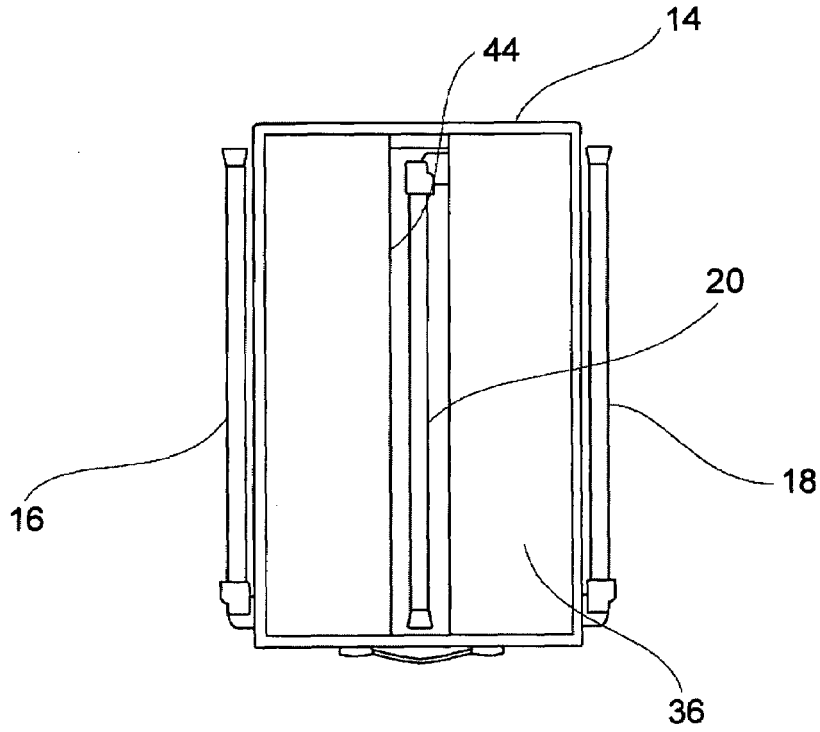
FIG. 7 is a bottom view of the base.

Referring back to FIG. 1, the first leg 16 and the second leg 18 are pivotally attached to the side walls 42 of the storage compartment 22. The third leg 20 is pivotally attached to the bottom wall 36. As shown in FIG. 7, the third leg 20 is received in a recess 44 that is provided in the bottom wall 36. The legs are telescopic to provide compact size when they are retracted. Extending and retracting the legs are facilitated with one touch locking buttons. The legs are made of aluminum to provide light weight.

Figure 8:
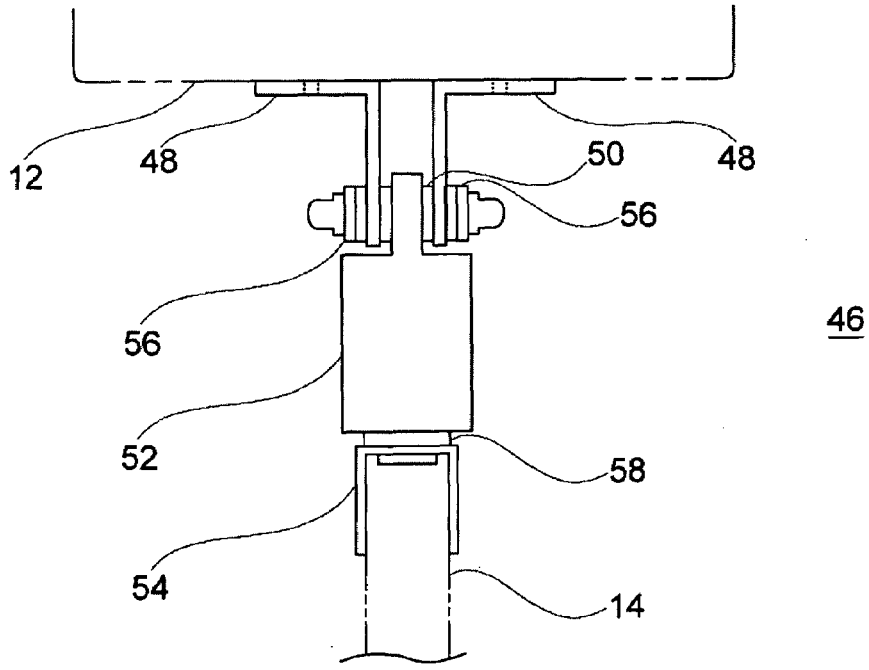
FIG. 8 is an elevation view of a connecting device.

Referring back to FIG. 1, the adjustable easel 10 further includes a connecting device 46 that connects the canvas holder 12 to the base 14. As shown in FIG. 8, the connecting device 46 includes two canvas holder bracket 48 that are fixed to the canvas holder 12, a first shaft 50 on which the canvas holder brackets 48 are rotatably attached so that the canvas holder 12 can be tilted, a second shaft 52 on which the first shaft 50 is fixed, and a base bracket 54 that is fixed to the base 14. The base bracket 54 is rotatably attached to the second shaft 52 so that the canvas holder 12 can swivel. The first shaft 50 is perpendicular to the second shaft 52. The base bracket 54 is fixed to the rear wall 40 of the base 14. In this way, the connecting device 46 provides maximum degree of freedom for the canvas holder 12 and a canvas 64 that is held by the canvas holder 12. With this construction, the canvas holder 12 can swivel 360° with respect to the base 14, and can tilt 235° with respect to the base 14.

The connecting device 46 further includes first elastic element 56 that is assembled on the first shaft 50 and presses the canvas holder bracket 48, and a second elastic element 58 that is assembled on the second shaft 52 and presses the base bracket 54.

Figure 9:
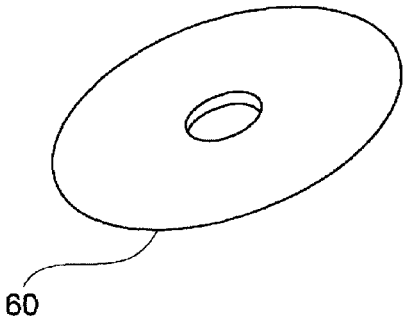
FIG. 9 is a perspective view of a cone-shaped spring washer.
Figure 10:
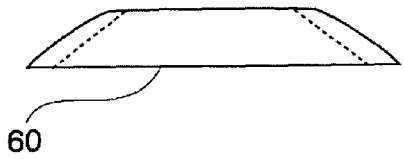
FIG. 10 is an elevation view of the spring washer.

As shown in FIGS. 9 and 10, each of the first elastic element 56 and the second elastic element 58 include a cone shaped spring washer 60.

Referring back to FIGS. 3 and 4, the canvas holder 12 includes a gripping device 62 that grips the canvas 64. The gripping device 62 is adjustable to accommodate different sizes of the canvas 64.

Figure 4:
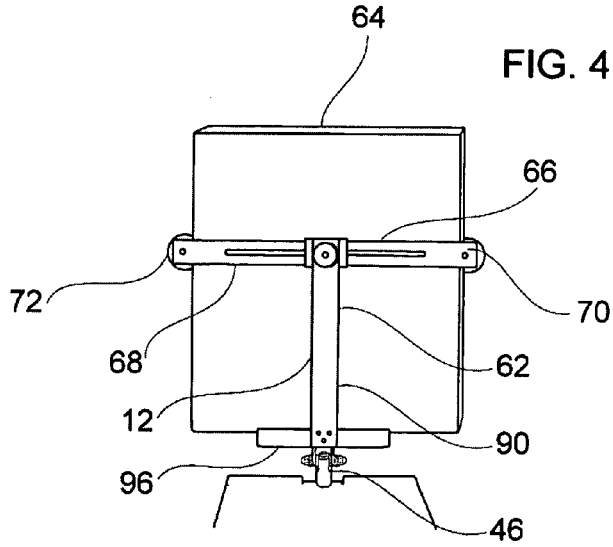
FIG. 4 is a perspective view of the canvas holder shown from the rear.
Figure 11:
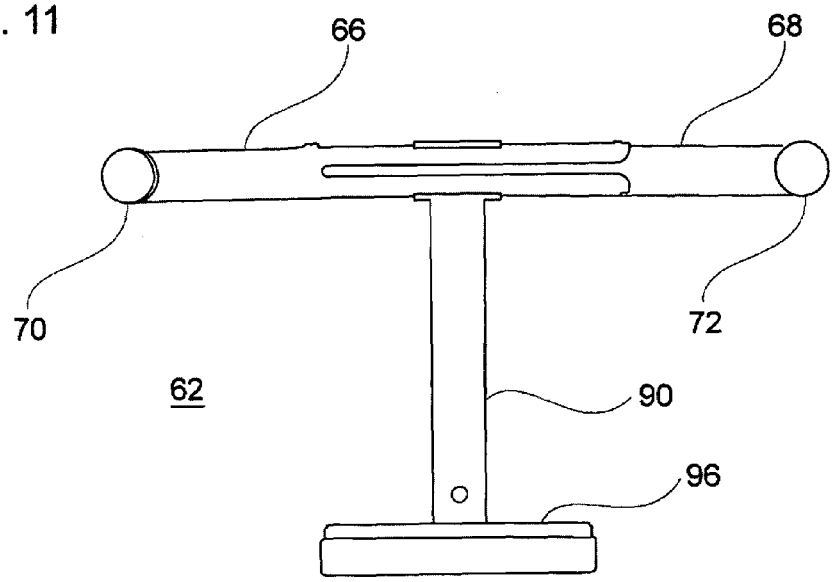
FIG. 11 is an elevation view of a gripping device.

As shown in FIGS. 4 and 11, the gripping device 62 includes a first bar 66, a second bar 68, a first end piece 70 and a second end piece 72. The first bar 66 partially overlaps the second bar 68 and the overlapping length is adjustable. The first end piece 70 is attached to the first bar 66 and contacts the canvas 64. The second end piece 72 is attached to the second bar 68 and contacts the canvas 64.

Figure 12:
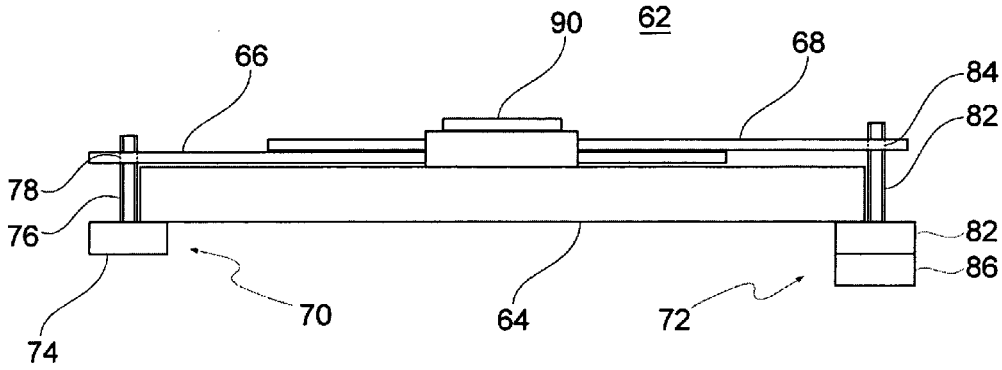
FIG. 12 is a partial plan view of the gripping device.

As shown in FIG. 12, the first end piece 70 includes a first knob 74 and a first threaded portion 76 extending from the first knob 74 and engaged with a first threaded hole 78 provide in the first bar 66. The second end piece 72 includes a second knob 80 and a second threaded portion 82 extending from the second knob 80 and engaged with a second threaded hole 84 provided in the second bar 68.

The first threaded portion 76 has a right-handed thread, and the second threaded portion 82 has a left-handed thread. In this way, the canvas 64 is conveniently guided between the first end piece 70 and the second end piece 72 by turning the first knob 74 clockwise and the second knob 80 counterclockwise, or vice versa. This operation is quite intuitive since the both knobs are turned inward or outward simultaneously.

The gripping device 62 further includes an auxiliary knob 86 that engages with the second knob 80, so that a thin object 88 such as a photograph can be held between the auxiliary knob 86 and the second knob 80 (refer to FIG. 1).

The canvas holder 12 further includes a supporting body 90 that supports the first bar 66 and the second bar 68 in a way that the first bar 66 and the second bar 68 slide on each other.

Figure 13:
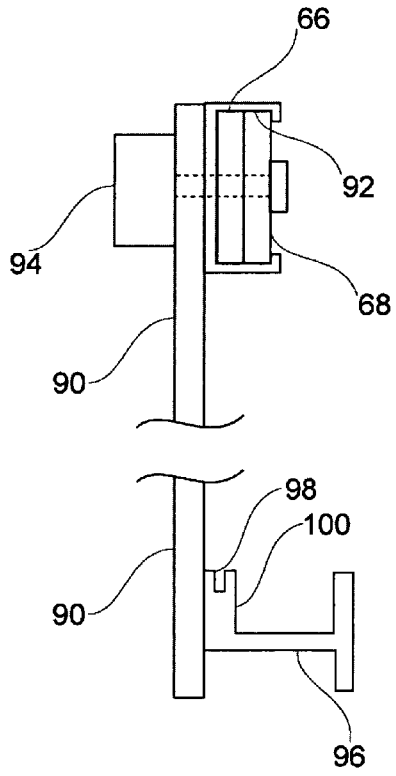
FIG. 13 is a side elevation view of a supporting body and a holding bar.

As shown in FIG. 13, the supporting body 90 includes a recess 92 that receives the first bar 66 and the second bar 68, and a fastener 94 that fastens the first bar 66 and the second bar 68 together. The recess 92 is provided on the upper end of the supporting body 90.

The canvas holder 12 further includes a holding bar 96 that is attached to the supporting body 90 and contacts the canvas 64. The holding bar 96 is provided on the lower end of the supporting body 90.

The holding bar 96 includes one or more elongated recesses 98, 100. Each of the elongated recesses 98, 100 has different width.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. An adjustable easel comprising:

a) a canvas holder; and b) a base;

wherein the canvas holder is attached to the base in a way that the canvas holder can swivel with respect to the base and the canvas holder can be tilted with respect to the base, wherein the base comprises three or more legs that are pivotally attached to the base, and the length of each of the legs is adjustable, wherein the base includes a storage compartment and one or more covers that cover the storage compartment in its closed position, and allow access into the storage compartment in its open position.

2. The adjustable easel of claim 1, wherein each of the covers is pivotally attached to the storage compartment with one or more hinges, wherein each of the hinges comprises a bracket that comprises a first plate and a second plate that is orthogonally extended from the first plate.

3. The adjustable easel of claim 1, wherein the storage compartment of the base has a rectangular shape and comprises a bottom wall, a front wall, a rear wall and two side walls.

4. The adjustable easel of claim 3, wherein the base comprises a first leg, a second leg and a third leg, wherein the first leg and the second leg are pivotally attached to the side walls of the storage compartment, wherein the third leg is pivotally attached to the bottom wall, wherein the third leg is received in a recess that is provided in the bottom wall, wherein the length of each of the legs is adjustable.

5. An adjustable easel comprising:

a) a canvas holder;

b) a base, wherein the canvas holder is attached to the base in a way that the canvas holder can swivel with respect to the base and the canvas holder can be tilted with respect to the base, c) a connecting device that connects the canvas holder to the base, wherein the connecting device comprises a canvas holder bracket that is fixed to the canvas holder, a first shaft on which the canvas holder bracket is rotatably attached whereby the canvas holder can be tilted, a second shaft on which the first shaft is fixed, and a base bracket that is fixed to the base, wherein the base bracket is rotatably attached to the second shaft whereby the canvas holder can swivel.

6. The adjustable easel of claim 5, wherein the connecting device further comprises first elastic element that is assembled on the first shaft and presses the canvas holder bracket, and a second elastic element that is assembled on the second shaft and presses the base bracket.

7. The adjustable easel of claim 6, wherein each of the first elastic element and the second elastic element comprises a cone-shaped spring washer.

8. An adjustable easel comprising:

a) a canvas holder; and b) a base;

wherein the canvas holder is attached to the base in a way that the canvas holder can swivel with respect to the base and the canvas holder can be tilted with respect to the base, wherein the canvas holder comprises a gripping device that grips a canvas, wherein the gripping device is adjustable to accommodate different sizes of the canvas, wherein the gripping device comprises a first bar, a second bar, a first end piece and a second end piece, wherein the first bar partially overlaps the second bar and the overlapping length is adjustable, wherein the first end piece is attached to the first bar and contacts the canvas, wherein the second end piece is attached to the second bar and contacts the canvas.

9. The adjustable easel of claim 8, wherein the first end piece comprises a first knob and a first threaded portion extending from the first knob and engaged with a first threaded hole provided in the first bar, wherein the second end piece comprises a second knob and a second threaded portion extending from the second knob and engaged with a second threaded hole provided in the second bar.

10. The adjustable easel of claim 9, wherein the first threaded portion has a right-handed thread, wherein the second threaded portion has a left-handed thread.

11. The adjustable easel of claim 9, wherein the gripping device further comprises an auxiliary knob that engages with the second knob, whereby a thin object can be held between the auxiliary knob and the second knob.

12. The adjustable easel of claim 8, wherein the canvas holder further comprises a supporting body that supports the first bar and the second bar in a way that the first bar and the second bar slide on each other.

13. The adjustable easel of claim 12, wherein the supporting body comprises a recess that receives the first bar and the second bar, and a fastener that fastens the first bar and the second bar together.

14. The adjustable easel of claim 12, wherein the canvas holder further comprises a holding bar that is attached to the supporting body and contacts the canvas.

15. The adjustable easel of claim 14, wherein the holding bar comprises one or more elongated recesses, wherein each of the elongated recesses has different width.

* * * * *